US012345250B2

(12) United States Patent
Yakimchuk et al.

(10) Patent No.: US 12,345,250 B2
(45) Date of Patent: Jul. 1, 2025

(54) LIGHTWEIGHT, LATTICE STRUCTURE HORSEHEAD FOR RECIPROCATING PUMP UNIT

(71) Applicant: TRC Services, Inc., The Woodlands, TX (US)

(72) Inventors: Darius J. Yakimchuk, St Albert (CA); Brent W. Pickens, Oklahoma City, OK (US); Robert G. McDonald, Argyle, TX (US)

(73) Assignee: TRC Services, Inc., The Woodlands, TX (US)

( * ) Notice: Subject to any disclaimer, the term of this patent is extended or adjusted under 35 U.S.C. 154(b) by 66 days.

(21) Appl. No.: 18/100,450

(22) Filed: Jan. 23, 2023

(65) Prior Publication Data

US 2024/0247653 A1 Jul. 25, 2024

(51) Int. Cl.
*F04B 47/02* (2006.01)
*E21B 43/12* (2006.01)

(52) U.S. Cl.
CPC ..... *F04B 47/028* (2013.01); *E21B 43/127* (2013.01); *F04B 47/022* (2013.01)

(58) Field of Classification Search
CPC ..... F04B 47/022; F04B 47/14; F04B 47/028; Y10T 74/18182
See application file for complete search history.

(56) References Cited

U.S. PATENT DOCUMENTS 4,092,872 A 6/1978 McClure
4,121,471 A 10/1978 Chancellor
4,651,578 A * 3/1987 Thompson ..... F04B 47/028 74/41
10,215,012 B2 2/2019 McDonald et al.
10,760,386 B2 * 9/2020 Yakimchuk ..... E21B 43/127
11,098,708 B2 8/2021 Schmitt et al.
11,174,856 B2 11/2021 Robison et al.
2016/0201664 A1 7/2016 Robison et al.
2019/0330964 A1 10/2019 Yakimchuk et al.
2020/0309112 A1 10/2020 Yakimchuk et al.

OTHER PUBLICATIONS

American International Manufacturing Corp, Aimco Catalogue, undated, 20-pgs.
Lufkin, "Conventional & Reverse Mark Pumping Units," Installation Manual CU-09, undated, available from thehistorycenteronline.com page Lufkin Oil Field Equipment Catalogs, Bulletins, Brochures, ca. 1926-2002, 61-pgs.
(Continued)

*Primary Examiner* — Gregory Robert Weber
(74) *Attorney, Agent, or Firm* — Cabello Hall Zinda, PLLC

(57) ABSTRACT

A horsehead is used on a walking beam of a reciprocating pump unit. The horsehead includes side plates, a face, tabs, and brace plates. The side plates are spaced apart, and the face affixed to front, arced edges of the side plates. The face defines a split therein extending from a bottom end toward a top end, and the tabs are affixed to the face across the split. The face thereby defines two runner surfaces. A fixture at the top end of the face can be used for connection to a bridle of the pump unit. The brace plates are connected in the space between the side plates and are arranged in a lattice structure. Preferably, the brace plates include cutouts to reduce weight.

25 Claims, 5 Drawing Sheets

(56) References Cited

OTHER PUBLICATIONS

Weatheford International, "Maximiser III," copyright 2018, pp. 28-34.
Weatherford International, "Ampscot(R) Operator's Manual," Manual, copyright 2015, 47-pgs.
Weatherford International, "Ampscot(TM) Pumping Units," Product Catalog Revision 1.0, copyright 2009, 34 pgs.

* cited by examiner

LIGHTWEIGHT, LATTICE STRUCTURE HORSEHEAD FOR RECIPROCATING PUMP UNIT

FIELD OF THE DISCLOSURE

The subject matter of the present disclosure is generally directed to a reciprocating pump unit and more particularly directed to a horsehead that is lightweight and has a lattice structure to reduce weight at the front end of the pumping unit for more efficient operation without sacrificing structural integrity.

BACKGROUND OF THE DISCLOSURE

Reciprocating pump systems, such as sucker rod pump systems, extract fluids from a well and employ a downhole pump connected to a driving source at the surface. A rod string connects the surface driving force to the downhole pump in the well. When operated, the driving source cyclically raises and lowers the downhole pump, and with each stroke, the downhole pump lifts well fluids toward the surface.

For example, FIG. 1 shows a sucker rod pump system 10 used to produce fluid from a well. A downhole pump 14 has a barrel 16 with a standing valve 24 located at the bottom. The standing valve 24 allows fluid to enter from the wellbore, but the standing valve 24 does not allow the fluid to leave. Inside the pump barrel 16, a plunger 20 has a traveling valve 22 located at the top. The traveling valve 22 allows fluid to move from below the plunger 20 to the production tubing 18 above, but the traveling valve 22 does not allow fluid to return from the tubing 18 to the pump barrel 16 below the plunger 20. A driving source (e.g., a pump jack or pumping unit 30) at the surface connects by a rod string 12 to the plunger 20 and moves the plunger 20 up and down cyclically in upstrokes and downstrokes.

During the upstroke, the traveling valve 22 is closed, and any fluid above the plunger 20 in the production tubing 18 is lifted towards the surface. Meanwhile, the standing valve 24 opens and allows fluid to enter the pump barrel 16 from the wellbore.

At the top of stroke, the standing valve 24 closes and holds in the fluid that has entered the pump barrel 16. Furthermore, throughout the upstroke, the weight of the fluid in the production tubing 18 is supported by the traveling valve 22 in the plunger 20 and, therefore, also by the rod string 12, which causes the rod string 12 to stretch. During the downstroke, the traveling valve opens, which results in a rapid decrease in the load on the rod string 12. The movement of the plunger 20 from a transfer point to the bottom of stroke is known as the "fluid stroke" and is a measure of the amount of fluid lifted by the pump 14 on each stroke.

At the surface, the pump unit 30 is driven by a prime mover 40, such as an electric motor or internal combustion engine, mounted on a pedestal above a base 32. Typically, a pump controller 36 monitors, controls, and records the pump unit's operation. Structurally, a Samson post 34 on the base 32 provides a fulcrum on which a walking beam 50 is pivotally supported by a saddle bearing assembly 35.

Output from the motor 40 is transmitted to a gearbox 42, which provides low-speed, high-torque rotation of a crankshaft 43. Both ends of the crankshaft 43 rotate crank arms 44 having counterbalance weights 46. Each crank arm 44 is pivotally connected to a pitman arm 48 by a crank pin bearing 45. In turn, the two pitman arms 48 are connected to an equalizer bar 49, which is pivotally connected to the rear end of the walking beam 50 by an equalizer bearing assembly 55.

A horsehead 52 with an arcuate forward face 54 is mounted to the forward end of the walking beam 50. As is typical, the face 54 may have tracks or grooves for carrying a flexible wire rope bridle 56. At its lower end, the bridle 56 terminates with a carrier bar 58, upon which a polished rod 15 is suspended. The polished rod 15 extends through a packing gland or stuffing box at the wellhead 13. The rod string 12 of sucker rods hangs from the polished rod 15 within the tubing string 18 located within the well casing and extends to the downhole pump 14.

The horsehead 60 must be very large to accommodate the longer stroke length created by a large, long stroke pumping unit. The arc length of the front face plate 66 (the runner) is as long as the stroke length of the polished rod 15 plus enough additional length to create sufficient runout. Thus, the arch length of the horsehead 60 must be proportionally large to match the longer the stroke length of the pumping unit 70. Consequently, the size of the horsehead 60 results in significant additional weight to the beam 50.

In the design of a conventional beam pumping unit 10, a goal is to achieve a neutral balance as near as possible between the front and back of the walking beam 50. The neutrally balanced walking beam 50 allows the least amount of counterbalance weight to lift the maximum load, resulting in greater mechanical and electrical efficiency for the pump unit 10.

The majority of horseheads 60 are fabricated from solid plate steel with the sole focus on compliance with API design specifications. For example, FIG. 2A shows a perspective view of a conventional horsehead 60, having adjacent sides 62*a-b*, a mounting bar 64, and a face plate 66 (i.e., runner). The sides 62*a-b* are made of solid plate steel and are mounted side-by-side, and the face plate 66 of plate steel is affixed to the curved edge 63*a* of the sides 62*a-b*. The mounting bar 64 is affixed between the sides 62*a-b*, and the face plate 66 can have a track or groove 67, such as for a bridle (not shown).

The horsehead 60 is of simple fabrication using solid sides 62*a-b* and face plate 66, and little consideration is given for handling or installation efficiency. As shown in this example, the horsehead 60 can have side plate cutouts 63*b* in the sides 62*a-b*. These cutouts 63*b* do reduce the weight of the horsehead 60 by a minor amount. However, the cutouts 63*b* are actually used as a means for saving steel plate material. In particular, FIG. 2B schematically shows a standard sized sheet 61 of steel plate. The two side plates 62*a-b* can be out of the single standard size sheet 61 to conserve material by using the interlocking pattern for the cutouts 63*b*. This practice has been used for over four decades. Nevertheless, the overall weight reduction is minimal.

The subject matter of the present disclosure is directed to overcoming, or at least reducing the effects of, one or more of the problems set forth above.

SUMMARY OF THE DISCLOSURE

A horsehead is disclosed herein for use on a walking beam of a reciprocating pump unit. The horsehead comprises side plates, a face, a plurality of tabs, and brace plates. The side plates are disposed adjacent to one another with a space therebetween. Each of the side plates has a front edge and a back edge. The face is affixed to the front edges of the side plates and has a top end and a bottom end. The face defines a split therein extending from the bottom end toward the top end. The tabs are affixed to the face across the split. The brace plates are connected in the space between the side plates and are arranged in a lattice structure.

A reciprocating pump unit disclosed herein comprises arms, an equalizer bar, a walking beam, and a horsehead as disclosed above. The arms are configured to translate on the reciprocating pump unit, and the equalizer bar is hingedly connected to the arms. The walking beam is mounted to pivot on the reciprocating pump unit. The horsehead is mounted on the walking beam.

A method is disclosed of fabricating horsehead for use on a walking beam of a reciprocating pump unit. The method comprises, not necessarily in sequence: forming side plates each having a front edge and a back edge; forming a face having a top end and a bottom end, the face defining a split therein extending from the bottom end toward the top end; forming brace plates; affixing the face to the front edges of the side plates; affixing a plurality of tabs to the face across the split; and affixing the brace plates in a lattice structure in a space between the side plates.

The foregoing summary is not intended to summarize each potential embodiment or every aspect of the present disclosure.

DETAILED DESCRIPTION OF THE DISCLOSURE

Figure 1:
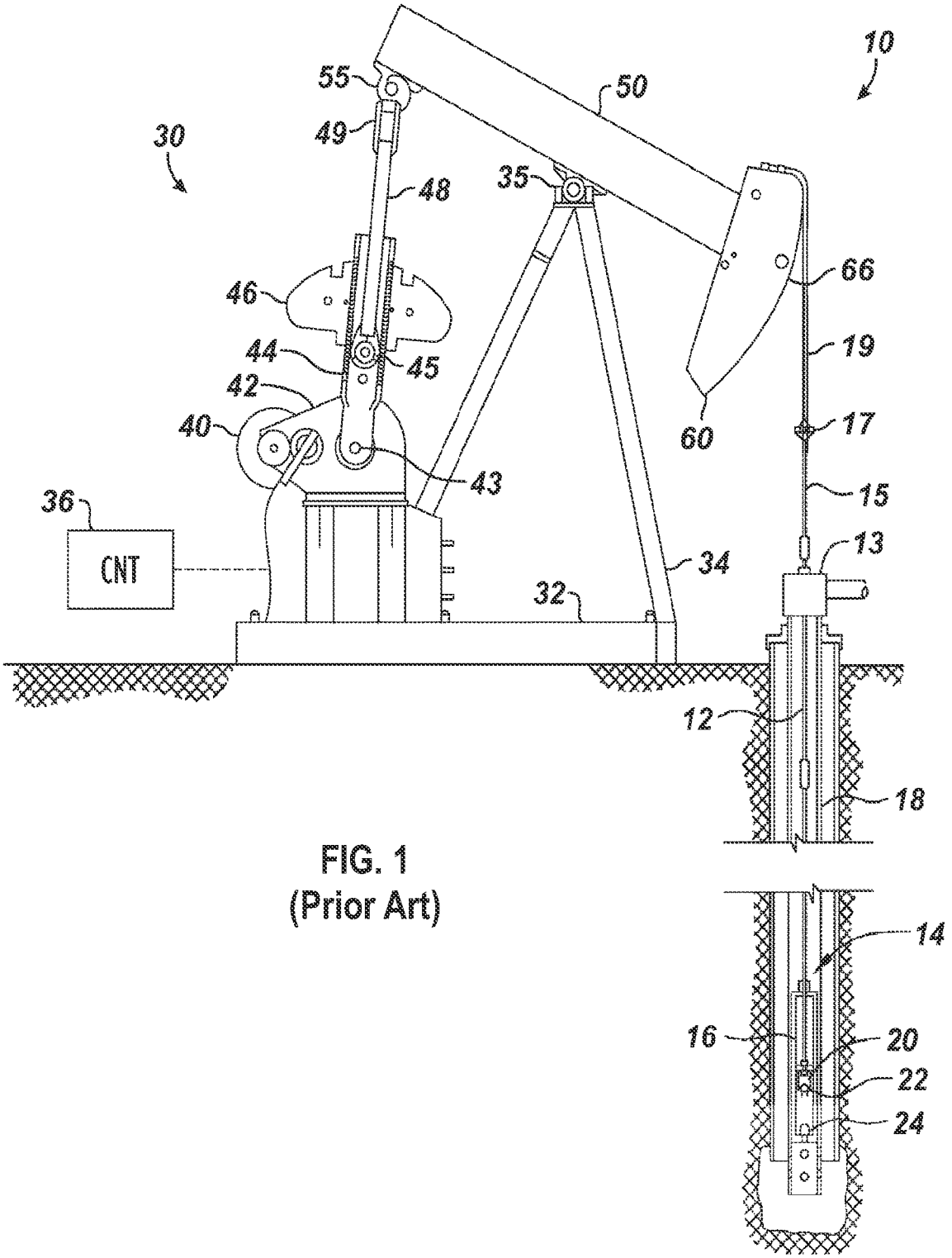
FIG. 1 (Prior Art)
FIG. 1 illustrates an example of a reciprocating rod pump system known in the art.
Figure 2A:
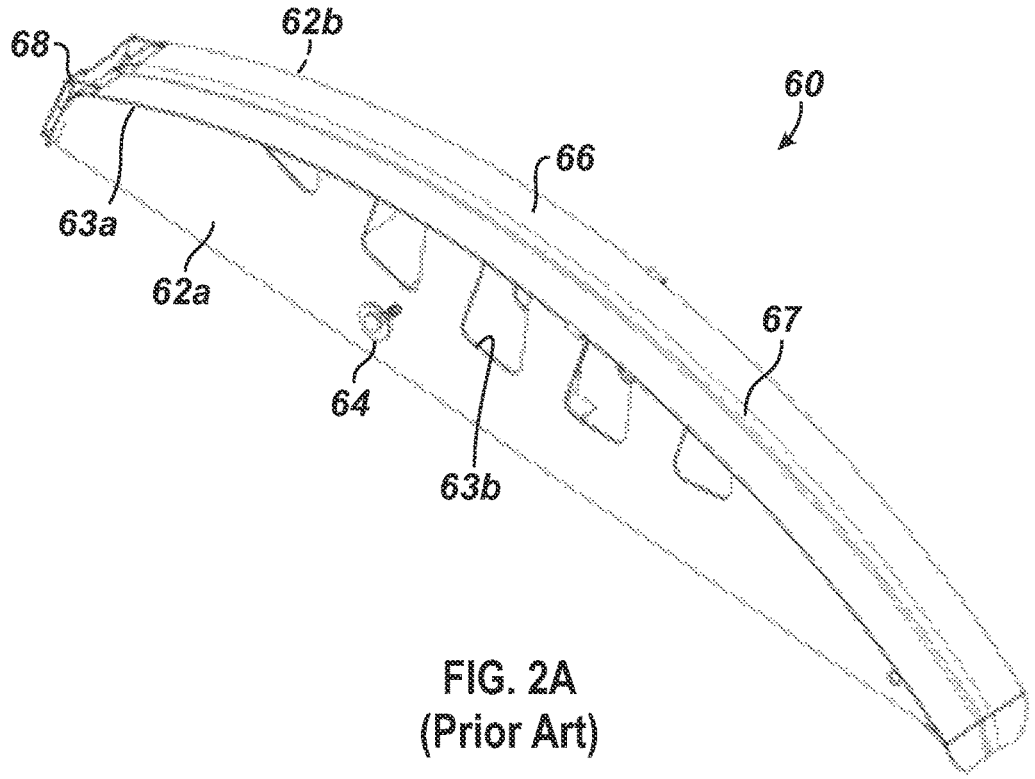
FIG. 2A (Prior Art)
FIG. 2A illustrates an example of conventional horsehead for a reciprocating pump unit.
Figure 2B:
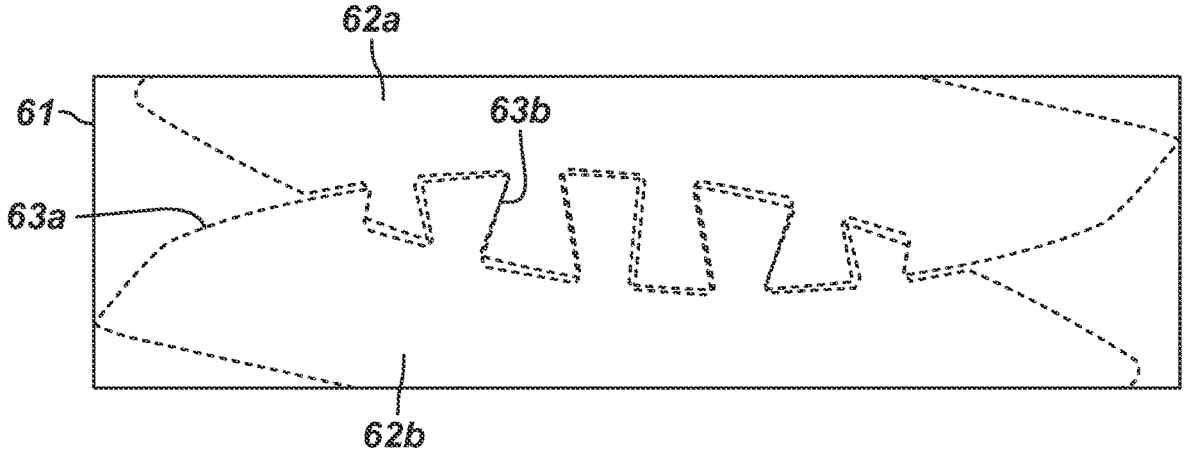
FIG. 2B (Prior Art)
FIG. 2B schematically illustrates a standard sized sheet of plate steel having an interlocking pattern of cutouts to form sides for a horsehead.
Figure 3:
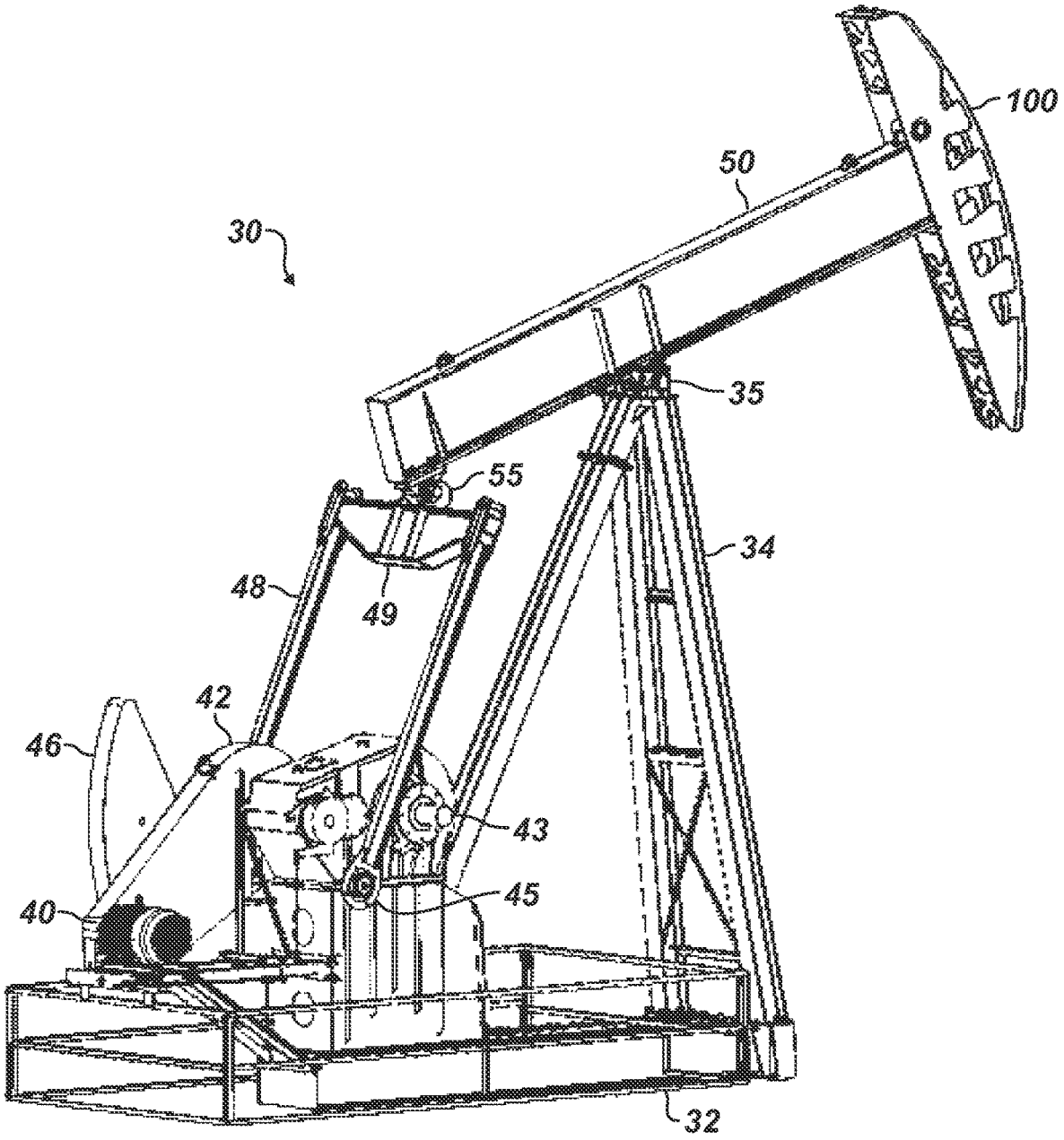
FIG. 3 illustrates a reciprocating pump unit having a horsehead according to the present disclosure.

FIG. 3 illustrates a reciprocating pump unit 30 of the present disclosure used to produce fluid from a well. The pump unit 30 is similar to that disclosed above with reference to FIG. 1 so that like reference numerals are used. As before, the pump unit 30 includes pitman arms 48, an equalizer bar 49, and a walking beam 50. A horsehead 52 is mounted to the forward end of the walking beam 50.

In general, the pitman arms 48 are configured to translate on the pump unit 30, and the equalizer bar 49 is hingedly connected to the arms 48. The walking beam 50 is mounted to pivot on the pump unit 30, and an equalizer bearing assembly 55 connects the equalizer bar 49 to the walking beam 50.

During operation, for example, the pump unit 30 is driven by a prime mover 40 mounted on a pedestal above a base 32. Structurally, a Samson post 34 on the base 32 provides a fulcrum on which the walking beam 50 is pivotally supported by a saddle bearing assembly 35.

Output from the motor 40 is transmitted to a gearbox 42, which provides low-speed, high-torque rotation of a crankshaft 43. Both ends of the crankshaft 43 rotate crank arms (one crank arm is not shown in FIG. 4 and the other crank arm is not visible), which have counterbalance weights 46. Each crank arm is pivotally connected to a pitman arm 48 by a crank pin bearing 45. In turn, the two pitman arms 48 are connected to the equalizer bar 49, which is pivotally connected to the rear end of the walking beam 50 by the equalizer bearing assembly 100 of the present disclosure.

As noted above, the walking beam 50 is preferably balanced (e.g., neutrally balanced or near neutral) between the front and back ends of the walking beam 50. This allows the least amount of counterbalance weight required to lift a maximum load, resulting in greater mechanical and electrical efficiency for the pump unit 30. Given the sheer size that the horsehead 100 needs to be for a long stroke pumping unit, any weight reduction is helpful in achieving the optimal balance. To conform to the required dimensional envelope with the lowest possible weight, the horsehead 100 disclosed herein achieves optimal support using the least amount of material.

Figure 4A:
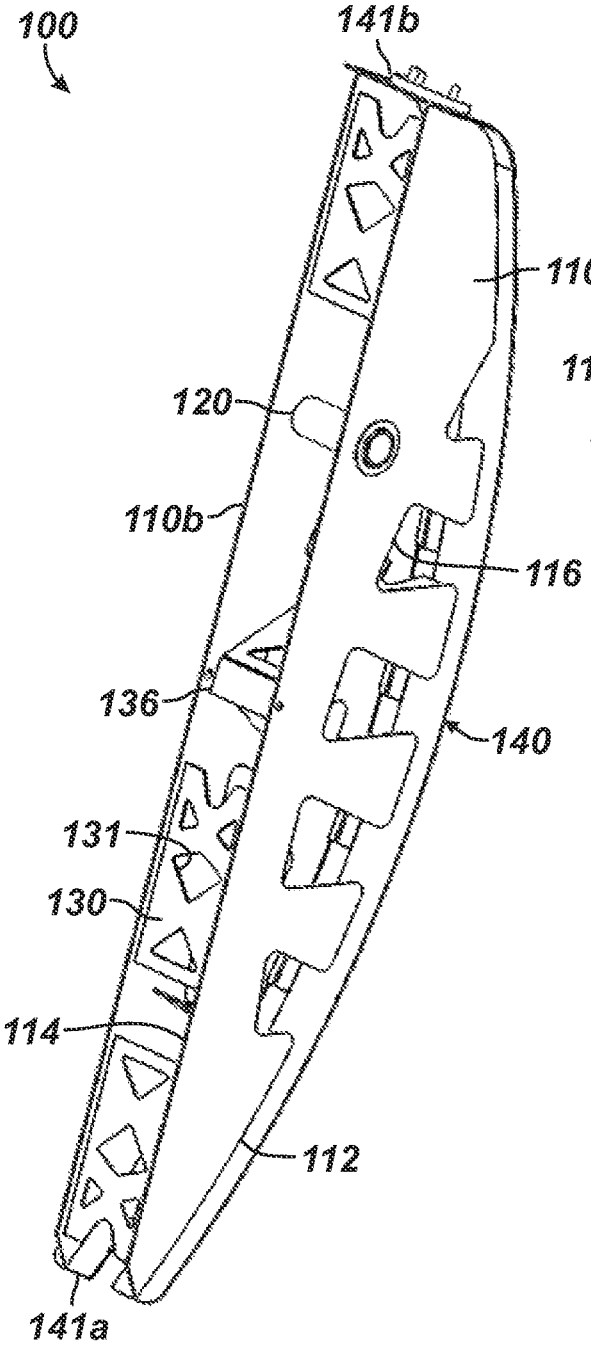
FIG. 4A illustrates a front perspective view of the disclosed horsehead.
Figure 4B:
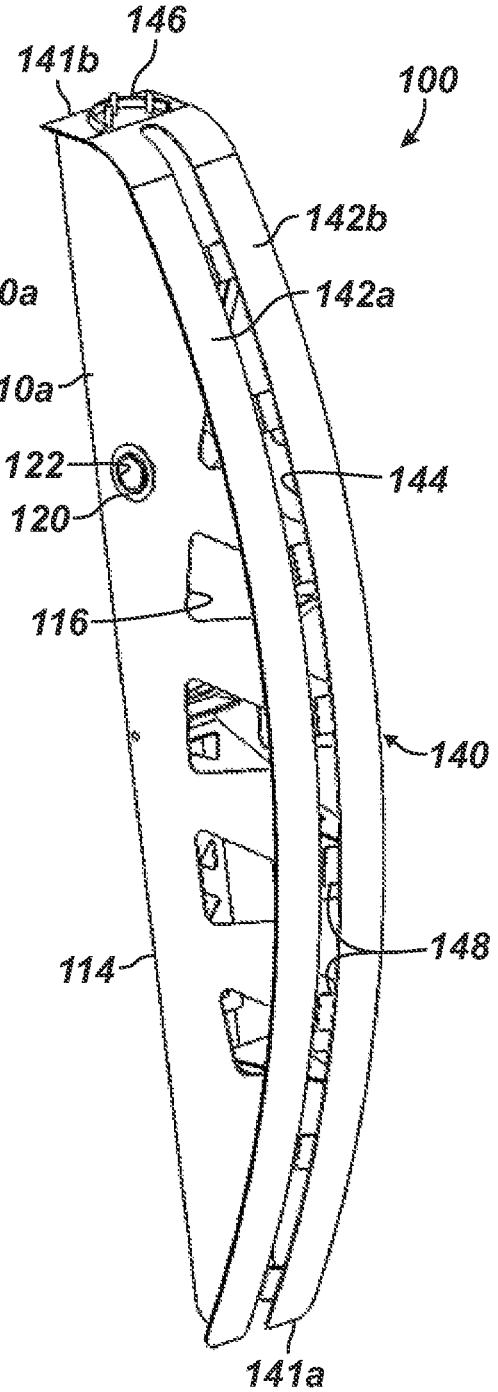
FIG. 4B illustrates a back perspective view of the disclosed horsehead.
Figure 5:
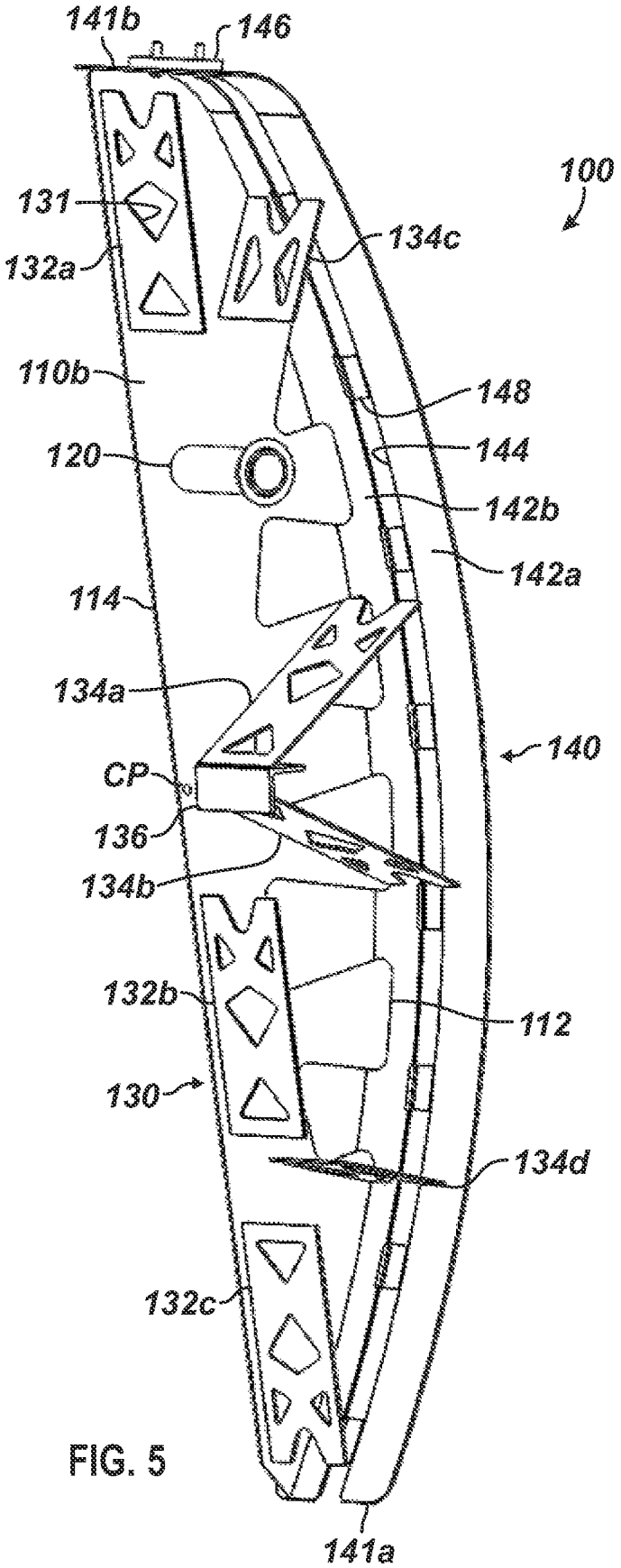
FIG. 5 illustrates the back perspective view of the disclosed horsehead with a side removed to illustrate internal components.

Turning to further details of the horsehead 100, FIG. 4A illustrates a front perspective view of the disclosed horsehead 100, and FIG. 4B illustrates a back perspective view of the disclosed horsehead 100. Meanwhile, FIG. 5 illustrates the back perspective view of the disclosed horsehead with a side removed to illustrate internal components.

The horsehead 100 includes side plates 110*a-b*, brace plates 130, a face 140, and a plurality of tabs 148. The side plates 110*a-b* are spaced adjacent to (parallel to) one another with a space therebetween. (The width of the space can be comparable to the width of the walking beam (50) on which the horsehead 100 mounts.) Each of the side plates 110*a-b* has a front edge 112 and a back edge 114. Each of the front edges 112 defines an arc for the stroke length of the pumping unit for which the horsehead 100 is used. The side plates 110*a-b* can define cutouts 116 in the front edge 112, which as noted may only minimally reduce weight but allows the side plates 110*a-b* to be fabricated from a standard sized sheet of plate material.

The brace plates 130 are connected in the space between the side plates 110*a-b* and are arranged in a lattice structure. The face 140 is affixed to the front edges 112 of the side plates 110*a-b* and has a bottom edge or end 141*a* and a top edge or end 141*b*. The face 140 defines a split 144 therein extending from the bottom end 141*a* toward the top end 141*b* so that the face 140 defines divided runner surfaces 142*a-b*. The tabs 148 are affixed to the face 140 across the split 144. As shown, the tabs 148 can be intermittently spaced along the split 144.

A mounting bar 120 is connected between the side plates 110*a-b* and is configured to mount the horsehead 100 to the walking beam (50). Preferably, the mounting bar 120 is a hollow tube having a passage 122. Not only does this reduce weight, but the hollow passage 122 through the mounting bar 120 can be exposed on the opposing sides of the horsehead 100. This allows operators to run a cable through the passage 122 of the mounting bar 120 for lifting and moving the horsehead 100.

As best shown in FIG. 5, the brace plates 130 include a bracket 136 connected in the space between the side plates 110*a-b* adjacent to a central point CP at the back edges 114. When the horsehead 100 is mounted, the end of the walking beam (50) is partially disposed in the space between the side plates 110*a-b* defined between the mounting bar 120 and the bracket 136.

As shown, the face 140 is made of plate material. Preferably, the face 140 is comprised of a unitary plate that has been cut to include the split 144 and has been bent to define the arc. The split 144 preferably extends from the bottom end 141*a* toward the top end 141*b*, but a portion of the top end 141*b* is left intact to interconnect the runner surfaces 142*a-b* of the face 140 separated by the split 144. Although the unitary construction is preferred, the face 140 can be formed in other ways, such as using a plurality of plates affixed together to define the runner surfaces 142*a-b*, the split 144, and the interconnecting top end 141*b*. The reciprocating pump unit (30) may use a bridle so the top end 141*b* of the face 140 can include a fixture 146 configured to connect to the bridle.

As generally shown, one or more of the brace plates 130 can define one or more cutouts 131. Preferably, a number of such cutouts 131 are made in the various brace plates 130 to reduce the weight of the brace plates 130 while maintaining structural integrity.

As best shown in FIG. 5, the brace plates 130 include a plurality of back plates 132*a-c* and a plurality of intermediate plates 134*a-d*. As also noted, the brace plates 130 include the bracket 136 connected in the space between the side plates 110*a-b* adjacent to this central point CP at the back edges 114. The back plates 132*a-c* are arranged in the lattice structure along the back edges 114 of the side plates 110*a-b*. Three such back plates 132*a-c* are shown so that a space is provided between the mounting bar 120 and bracket 136 for fitting of walking beam's end. The intermediate plates 134*a-d* are arranged in the lattice structure from the back edges 114 toward the front edges 112. These intermediate plates 134*a-d* are angled outward from the central point CP at the back edges 114.

The sheet of plate material used to fabricate the side plates 110*a-b* can be composed of a conventional material (e.g., steel) and can have a suitable thickness The sheet of plate material for the face 140 can be similarly composed of conventional material (e.g., steel) and can have a suitable thickness. The sheet of plate material for brace plates 130 can be similarly composed of conventional material (e.g., steel) and can have a suitable thickness.

Fabricating the horsehead 100 can include forming the side plates, the face, brace plates, and other components by cutting, stamping, bending, etc. various sheets of plate or another stock material. Affixing the components together can use welding processes and can be done in an appropriate order allowing the assembly to be achieved.

As disclosed herein, the horsehead 100 has a lightweight, box lattice construction. The horsehead 100 includes an internal bracing system composed of configured brace plates 130 supporting notched side plates 110*a-b* and split individual face runners 142*a-b*. All of these components are assembled into a lattice structure possessing the same or greater load bearing capacity of the more common solid plate horseheads seen in the majority of pumping units. Additionally, as opposed to a solid bar, the mounting bar 120 is a hollow tube, which saves additional weight. Furthermore, the mounting bar 120 is positioned to allow it to be used as the pickup point for mounting the horsehead 110 onto the walking beam 50 to allow safer and simpler assembly.

The lightweight, box lattice horsehead 100 provides an efficient means to minimize the weight at the frontend of the beam pumping unit 30, which minimizes the amount of counterbalance weight required to lift a given well load. This contributes to lower energy consumption of the pumping unit 30, which in turn reduces operating costs, increases energy efficiency, and lowers the overall carbon footprint.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A horsehead for use on a walking beam of a reciprocating pump unit, the horsehead comprising:
- side plates disposed adjacent to one another with a space therebetween, each of the side plates having a front edge and a back edge;
- a face affixed to the front edges of the side plates and having a top end and a bottom end, the face defining a split therein extending from the bottom end toward the top end;
- a plurality of tabs affixed to the face across the split; and
- brace plates connected in the space between the side plates and being arranged in a lattice structure, the brace plates including:
  - a plurality of back plates arranged in the lattice structure along the back edges of the side plates; and
  - a plurality of intermediate plates arranged in the lattice structure from the back edges toward the front edges and being angled outward from a central point at the back edges.

2. The horsehead of claim 1, comprising a mounting bar connected between the side plates and being configured to mount the horsehead to the walking beam.

3. The horsehead of claim 2, wherein the mounting bar is a hollow tube.

4. The horsehead of claim 2, wherein the brace plates include a bracket connected in the space between the side plates adjacent to the central point at the back edges; and wherein the horsehead is configured to mount on an end of the walking beam partially disposed in the space between the side plates defined between the mounting bar and the bracket.

5. The horsehead of claim 1, wherein the front edges of the side plates define cutouts.

6. The horsehead of claim 1, wherein each of the front edges defines an arc.

7. The horsehead of claim 1, wherein the face comprises plate material defining the split therein from the bottom end toward the top end, the top end connecting first and second runners together, the first and second runners split by the split along the plate material.

8. The horsehead of claim 1, wherein the top end of the face comprises a fixture configured to connect to a bridle of the reciprocating pump unit.

9. The horsehead of claim 1, wherein the face is comprised of a unitary plate or a plurality of plates affixed together.

10. The horsehead of claim 1, wherein each of one or more of the brace plates define one or more cutouts.

11. The horsehead of claim 1, wherein the brace plates include a bracket connected in the space between the side plates adjacent to the central point at the back edges.

12. The horsehead of claim 1, wherein each of the tabs comprises a bent plate bent having ends affixed respectively to the face across the split.

13. A reciprocating pump unit, comprising:

arms configured to translate on the reciprocating pump unit;

an equalizer bar hingedly connected to the arms;

a walking beam mounted to pivot on the reciprocating pump unit; and a horsehead mounted on the walking beam, the horsehead comprising:

side plates disposed adjacent to one another with a space therebetween, each of the side plates having a front edge and a back edge;

a face affixed to the front edges of the side plates and having a top end and a bottom end, the face defining a split therein extending from the bottom end toward the top end;

a plurality of tabs affixed to the face across the split; and brace plates connected in the space between the side plates and being arranged in a lattice structure, the brace plates including:

a plurality of back plates arranged in the lattice structure along the back edges of the side plates; and a plurality of intermediate plates arranged in the lattice structure from the back edges toward the front edges and being angled outward from a central point at the back edges.

14. A method of fabricating a horsehead for use on a walking beam of a reciprocating pump unit, the method comprising, not necessarily in sequence:

forming side plates each having a front edge and a back edge;

forming a face having a top end and a bottom end, the face defining a split therein extending from the bottom end toward the top end;

forming brace plates including back plates and intermediate plates;

affixing the face to the front edges of the side plates;

affixing a plurality of tabs to the face across the split; and affixing the brace plates in a lattice structure in a space between the side plates by:

arranging the back plates in the lattice structure along the back edges of the side plates; and arranging the intermediate plates in the lattice structure from the back edges toward the front edges and being angled outward from a central point at the back edges.

15. The method of claim 14, comprising connecting a mounting bar between the side plates, the mounting bar being configured to mount the horsehead to the walking beam.

16. The method of claim 15, wherein the mounting bar is a hollow tube.

17. The method of claim 15, wherein affixing the brace plates comprises affixing a bracket connected in the space between the side plates adjacent to the central point at the back edges; and wherein the method further comprises mounting the horsehead on an end of the walking beam partially disposed in the space between the side plates defined between the mounting bar and the bracket.

18. The method of claim 14, wherein forming the side plates comprises defining cutouts in the front edge.

19. The method of claim 14, wherein forming the side plates comprises defining each of the front edges to have an arc.

20. The method of claim 14, wherein forming the face comprises forming the face from plate material.

21. The method of claim 14, the reciprocating pump unit using a bridle, wherein the method comprises affixing a fixture configured to connect to a bridle on the top end of the face.

22. The method of claim 14, wherein forming the side plates comprises forming the side plates from a unitary plate or a plurality of plates affixed together.

23. The method of claim 14, wherein forming the brace plates comprises defining one or more cutouts in each of one or more of the brace plates.

24. The method of claim 14, wherein affixing the brace plates comprises connecting a bracket connected in the space between the side plates adjacent to the central point at the back edges.

25. The method of claim 14, wherein affixing the plurality of tabs to the face across the split comprises affixing, for each of the tabs, ends of a bent plate respectively to the face across the split.

* * * * *